US007127321B2

(12) United States Patent
Kenji et al.

(10) Patent No.: US 7,127,321 B2
(45) Date of Patent: Oct. 24, 2006

(54) DEVICE FOR DESIGNING TUBULAR KNOT FABRIC AND METHOD OF DESIGNING

(75) Inventors: Nishida Kenji, Wakayama (JP); Terai Koichi, Wakayama (JP)

(73) Assignee: Shima Seiki Manufacturing, Ltd., Wakayama (JP)

( * ) Notice: Subject to any disclaimer, the term of this patent is extended or adjusted under 35 U.S.C. 154(b) by 73 days.

(21) Appl. No.: 10/525,362

(22) PCT Filed: Jul. 28, 2003

(86) PCT No.: PCT/JP03/09552

§ 371 (c)(1),
(2), (4) Date: Feb. 23, 2005

(87) PCT Pub. No.: WO2004/022828

PCT Pub. Date: Mar. 18, 2004

(65) Prior Publication Data

US 2006/0142891 A1 Jun. 29, 2006

(30) Foreign Application Priority Data

Aug. 30, 2002 (JP) ..... 2002-253704

(51) Int. Cl.
*D04B 15/66* (2006.01)

(52) U.S. Cl. ..... 700/141; 66/232

(58) Field of Classification Search ..... 700/131, 700/141, 130; 66/231, 232, 237
See application file for complete search history.

(56) References Cited

U.S. PATENT DOCUMENTS

| | | | | |
|---|---|---|---|---|
| 4,346,366 | A * | 8/1982 | Kajiura et al. | 700/141 |
| 4,608,642 | A * | 8/1986 | Shima | 700/141 |
| 4,856,104 | A * | 8/1989 | Stoll et al. | 700/141 |
| 5,388,050 | A * | 2/1995 | Inoue et al. | 700/131 |
| 5,719,777 | A | 2/1998 | Kotaki | |
| 5,754,431 | A | 5/1998 | Kotaki | |
| 6,688,144 | B1 * | 2/2004 | Nishikawa et al. | 66/232 |
| 6,698,253 | B1 * | 3/2004 | Stoll et al. | 66/232 |

FOREIGN PATENT DOCUMENTS

JP 7-70889 A 3/1995

* cited by examiner

*Primary Examiner*—Danny Worrell
(74) *Attorney, Agent, or Firm*—Rothwell, Figg, Ernst & Manbeck, P.C.

(57) ABSTRACT

Shapes of a front and a rear part of a tubular knit fabric are displayed on a monitor, and the input of a pattern across the front and rear knit fabrics is received. When a user appoint on the monitor a start point of the pattern on the knit fabric, the pattern is extended in the direction going around the front and rear knit fabrics such that the pattern is substantially continued from the start point of the pattern across both front and rear knit fabrics and on edges between the front and rear knit fabrics. The pattern extended is displayed on the monitor, laid over the shapes of the front and rear knit fabrics.

6 Claims, 7 Drawing Sheets

DEVICE FOR DESIGNING TUBULAR KNOT FABRIC AND METHOD OF DESIGNING

CROSS REFERENCE TO RELATED APPLICATION

This application is a 35 USC § 371 National Phase Entry Application from PCT/JP03/09552, filed Jul. 28, 2003, and designating the United States.

FIELD OF THE INVENTION

The present invention relates to a design for a tubular fabric and particularly relates to the design for a pattern extending to between front and rear fabrics of a tubular fabric.

RELATED ART

It has been known to knit a front and rear fabrics in a tubular form by using a flat knitting machine. For example, knitting a front body and a rear body in the tubular form and processing such as a neck hole and a arm hole allow knitting a vest substantially without sewing. Adding a pair of tubular fabrics for both sleeves thereto, knitting a tubular fabric of a body and the tubular fabrics of both the sleeves at the same time, and connecting the tubular fabrics of both the sleeves to the tubular fabric of the body at the point of the arm hole allow knitting a sweater and a one-piece clothing, and so on, nearly without sewing.

The tubular fabric requires a suitable design method. And, it has been well known, before designing the tubular fabric become required, that fabrics are designed by inputting an external shape of a fabric in a design apparatus and designating stitch species for the inside of the external shape by using a color code. Regarding the design for tubular fabrics, Japanese patent 2913266 of the applicant proposes, for checking design matching of the front and rear fabrics, to reverse racking directions and the stitch species of face and rear stitches in the design of one fabric and to display in composition with the design for the other fabric.

SUMMARY OF THE INVENTION

Object of the Invention

A primary object of the present invention is to make it easy to design a pattern extending to between front and rear fabrics, specifically, to make no interruption of the pattern extending to between the front and rear fabrics and also to prevent from occurring a discontinuity of the pattern at the edge between front and rear fabrics with designating a start point of the pattern.

An auxiliary object of the present invention is to make it easy to input a pattern around the front and rear fabrics, with repeating a unit pattern, specifically, to make it possible to easily confirm whether the unit pattern continuously connects to each other, when the unit pattern is repeated to round between the front and rear fabrics.

An auxiliary object of the present invention is to enable to design a pattern including a stitch transfer across the edge between the front and rear fabrics.

An auxiliary object of the present invention is to enable the automatic detection of a discontinuous pattern, when the unit pattern is repeatedly rounded around the front and rear fabrics.

An auxiliary object of the present invention is to enable a user of the apparatus to adjust stitch numbers of the front and rear fabrics so as to make the pattern continuous, when the discontinuity in the pattern is detected.

Features of the Invention

In a design apparatus of the invention, the apparatus designing the tubular fabric composed of front and rear fabrics and producing knitting data allowing a flat knitting machine having at least a pair of front and rear needle beds to knit the tubular fabric, is characterized by: a monitor to display an external shape of the front and rear fabrics and a pattern on the fabrics; pattern input means for receiving input of a pattern extending to both the front and rear fabrics and for receiving input of a start point in the fabrics according to the designation of the point on the monitor by a user; and pattern development means for developing the pattern along with a direction around the front and rear fabrics from the start point in such a way that the developed pattern extends to both the front and rear fabrics and is substantially continuous at an edge between the front and rear fabrics, wherein species of stitches in the fabrics are designated so as to express the pattern in front and rear fabrics by the pattern development, and wherein species of face and rear stitches and racking direction along a left and right direction are inverted when the pattern crosses said edge.

In a design apparatus and a design method of the invention, species of face and rear stitches and racking direction along a left and right direction are inverted when the pattern crosses the edge. This processing may be operated at a real time during a design process or may be carried out as a single unit at the time of design completion.

Preferably, the pattern development means is adapted for repeating an unit pattern in such a way that the repeated unit patterns round the front and rear fabrics when the pattern inputted from the pattern input means includes repetition of the unit pattern, and the pattern developed so as to round the front and rear fabrics is displayed on the monitor in composition with the external shape of the fabric.

Preferably, the pattern development means determines a needle thereto to transfer a stitch to be transferred across said edge, in the opposite needle bed to the one when transfer is made within the edge, as reversing from the edge according to a stitch number across the edge.

More preferably, the apparatus is provided with detection means for detecting discontinuity in the pattern due to discrepancy of stitch number when the unit pattern is developed so as to round the front and rear fabrics. Particularly preferably, the apparatus is provided with stitch number adjustment means for displaying the discontinuity in the pattern on the monitor, for displaying on query whether adjustment in the stitch number is done, and for adjusting the stitch number of the front and rear fabrics, in response to input requesting the adjustment in the stitch number, so as to make the pattern substantially continuous.

Functions and Advantageous Effects of the Invention

In the invention, a design method for a tubular fabric having front and rear fabrics, the method producing knitting data allowing a flat knitting machine having at least a pair of front and rear needle beds to knit the tubular fabric, is characterized by: displaying an external shape of the front and rear fabrics on a monitor; receiving input of a pattern extending to both the front and rear fabrics and for receiving input of a start point of the pattern by user's designation of the point in the fabrics on the monitor; and developing the pattern along with a direction around the front and rear fabrics from the start point in such a way that the developed pattern extends to both the front and rear fabrics and is substantially continuous at an edge between the front and rear fabrics, wherein species of stitches in the fabrics are designated so as to express the pattern in front and rear fabrics by said development, wherein species of face and rear stitches and racking direction along a left and right direction are inverted when the pattern crosses said edge, and wherein the developed pattern is displayed on the monitor in composition with the external shape of the front and rear fabrics.

According to the design apparatus of the present invention, a user (operator) inputs the pattern extending to both front and rear fabrics, designates the start point of the pattern, the pattern is developed extending to the position to both the front and rear fabrics. For developing the pattern, the pattern is substantially made continuous at the edge between front and rear fabrics and the pattern is developed to extend to both the front and rear fabrics (tubular fabric.) Therefore, inputting the pattern and inputting the start point of the pattern make design for the pattern extending to both the front and rear fabrics possible on the tubular fabric. The designed pattern is continuous across front and rear fabrics and is not discontinuous on the edge.

Preferably, inputting the unit pattern and inputting the start point thereof causes development of repeated unit patterns to round around the front and rear fabrics. The developed pattern is displayed in composition with an external shape of the fabric and, thus, the user can easily confirm whether the unit pattern continues in one cycle. Therefore, the unit pattern inputted and its start point designated by the user enable to design a rounding pattern around the front and rear fabrics and, also, enable to confirm easily a state of development of the unit pattern.

Preferably, the stitch transfer address is determined in the needle bed opposite to the one to which a stitch to be transferred within the edge is transferred and as reversing from the edge in accordance with the stitch number beyond the edge. Therefore, if the stitch to be transferred beyond the edge is present, the pattern can be developed to be continuous at the edge, in other words, to be continuous across the edge into the other fabric.

Preferably, a discontinued pattern caused by inconsistency of stitch number is detected, when the unit pattern is developed around the front and rear fabrics. Therefore, for example, a message for the discontinuity can be displayed on the monitor to make it easier to design a rounding pattern around the front and rear fabrics by repeating the unit pattern.

When the discontinuity is detected, it is displayed on the monitor or other devices with a query of whether adjustment of stitch number of front and rear fabrics is necessary. If the user selects stitch number adjustment, stitch number is adjusted to make the pattern continuously rounded. As a result, the user can easily solve the object of the discontinuous pattern caused by mismatching of stitch number.

According to the design method for the tubular fabric of the present invention, inputting the pattern and the start point thereof by the user enables continuous development of the pattern extending to both the front and rear fabrics to prevent discontinuity at the edge between them. In addition, the monitor can display the developed pattern in composition with the external shape and, thus, the user can easily confirm the state of the pattern.

EMBODIMENTS

Figure 1:
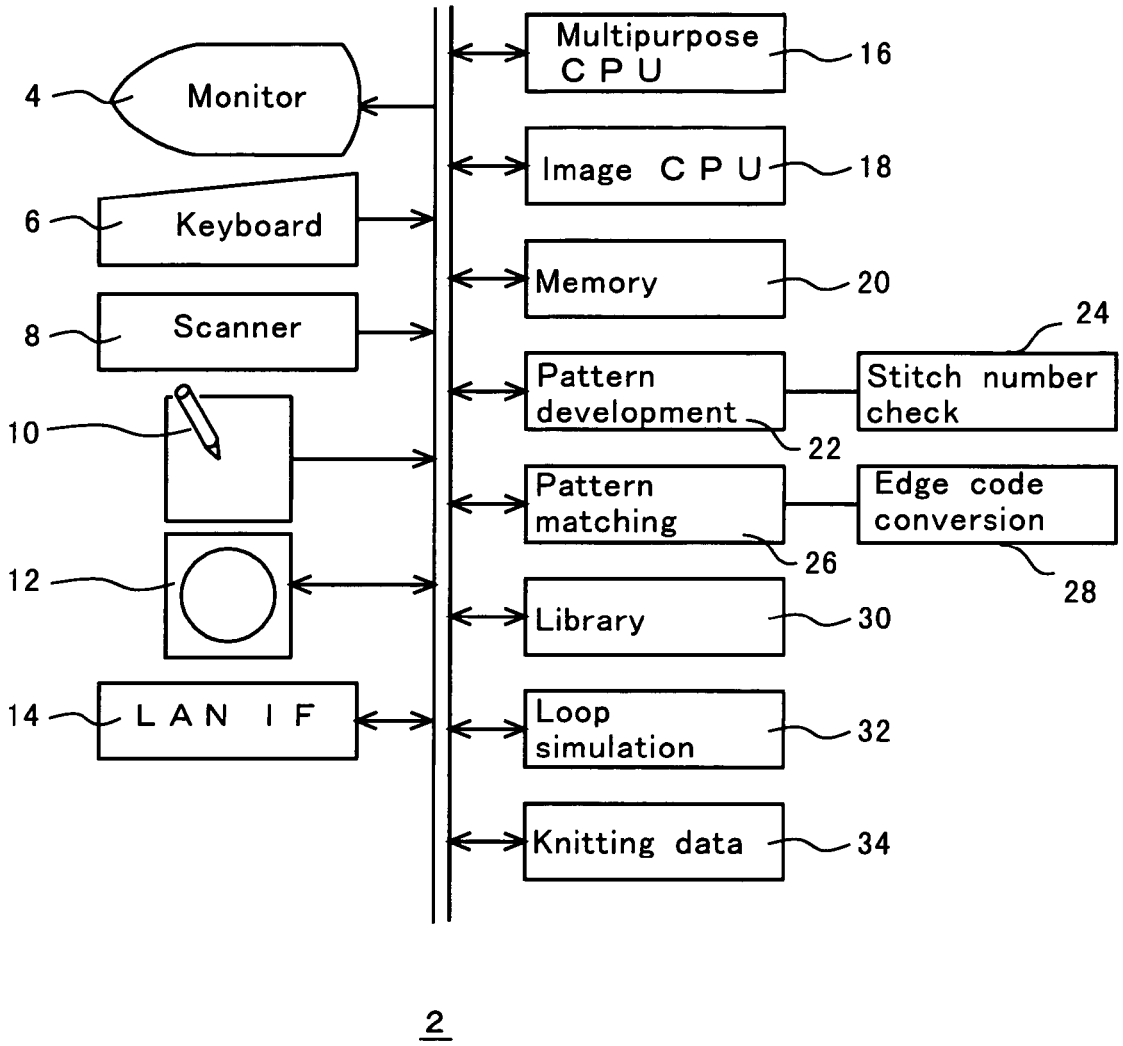
FIG. 1 is a block diagram of a design apparatus for a tubular fabric according to the embodiment.

FIG. 1 to FIG. 10 show the example. FIG. 1 shows hardware of a design apparatus 2 for a tubular fabric according to the embodiment. In an input output system, 4 denotes a monitor, 6 denotes a keyboard, and 8 denotes a scanner. 10 denotes a stylus used for designating a position on a digitizer resulting in designating the position on an image displayed on a monitor. 12 denotes an auxiliary memory device such as an optical disk and a hard disk; in this embodiment, both the auxiliary storage device itself and its drive are installed. 14 denotes a LAN interface and may not be installed.

The monitor 4 displays the outer pattern of the designed tubular fabric, the pattern developed on the tubular fabric, and the state where the pattern is developed on the tubular fabric. The monitor 4 displays further a variety of messages necessary for designing the pattern on the tubular fabric, and the keyboard 6 is used for inputting numerals and inputting commands. The scanner 8 is used for inputting a fabric pattern and inputting a knit pattern for jacquard, etc. The stylus 10 is used as a versatile drawing input, particularly used for designating a position in an image on the monitor 4. Replacing to the stylus 10, such inputting means as a track ball and a joystick may be installed.

Multipurpose CPU 16 executes various proceedings and operations, particularly, operates processing of an inputted command and control of an input output system. Image CPU 18 operates various proceedings of the image inputted in the design apparatus 2 and the image generated by the design apparatus 2. 20 denotes a memory used for storing an image inputted or generated, storing a variety of working data in a process of an image processing, and buffering necessary for development of the pattern.

22 is a pattern development processing unit, that operates processing of development of the pattern extending to between front and rear fabrics and has stitch number check processing unit 24. The stitch number check processing unit 24 checks a possibility of discontinuity due to mismatching of a size of the unit pattern with a stitch number of the fabric, when the unit pattern rounds around between the front and rear fabrics. In other words, when the unit pattern rounds repeatedly around the tubular fabric, the check is carried out for whether a remainder is produced in the stitch number of the tubular fabric, the total stitch number of front and rear fabrics. For example, if the stitch number rounded around front and rear fabrics is twice the stitch number necessary for the unit pattern, the stitch number corresponds to the unit pattern causing no discontinuity of the rounding pattern.

The pattern development processing unit 22 displays the remainder on the monitor 4, when the remainder is found by check of the stitch number and displays the query of whether the stitch number should be altered on the monitor 4. In response to this, when alteration of the stitch number is inputted by a user, the stitch number of front and rear fabrics is altered, for example, in a same number, to eliminate the remainder.

26 is a pattern matching processing unit and when a starting point of the pattern is inputted, the pattern is developed to extend to front and rear fabrics starting from the point as the starting point. When the unit pattern is repeated to round around the tubular fabric, if check of stitch number shows no remainder, the unit pattern should round around the tubular fabric without interruption and discontinuity of the unit pattern. The pattern matching processing unit 26 reverses the direction of development of the pattern to round around the tubular fabric, when the pattern is developed from the one fabric (e.g., front fabric) to the other fabric (e.g., rear fabric,) if the edge between fabrics is crossed. For example, in the case where the unit pattern is rounded from a central part of the front fabric to the right side, if the edge between front and rear fabrics is crossed, the direction of rounding is altered from the left end to the right end side of the rear fabric. Further, when the edge between fabrics is crossed, the front or back (face or rear stitch,) that is the species of the stitch, is reversed from each other and the racking direction of the stitch is reversed from each other between the front fabric and the rear fabric.

The pattern matching processing unit 26 has edge code conversion processing unit 28. The edge code conversion processing unit 28 turns back the stitch, which is transferred to cross the edge between front and rear fabrics, from the edge in the opposite direction according to the number of the stitch to be transferred beyond the edge and converts the stitch transfer address to the opposite needle bed in comparison with the case where the edge is not crossed. In this specification, the code means knitting data for individual stitches.

30 is a library to store a variety of patterns used for designing the fabric, stores the pattern as a whole in case of a big pattern that appears once without repetition, and, in case of the pattern obtained by repeating the unit pattern, stores the unit pattern. The library 30 stores also a variety of auxiliary files, e.g., steps of binding off, widening, and narrowing, necessary for knitting the tubular fabric. 32 is a loop simulation-processing unit used for simulating to express a loop of each stitch of the tubular fabric with a virtual knit yarn on the basis of knitting data prepared by the design apparatus 2 and for displaying on the monitor 4. The loop simulation-processing unit 32 simulates realistically the designed tubular fabric.

34 is a knitting data generation unit to convert the design data of the tubular fabric, which is generated by the design apparatus 2, to knitting data for an imaginal flat knitting machine. The species of the flat knitting machine are those having, at least, a pair of front and back needle beds. However, the flat knitting machine may have 4 needle beds in total, which are composed of 2 needle beds each in the top and bottom of the front and back positions. The flat knitting machine includes various species and the knitting data generation unit 34 converts design data to imaginal knitting data common through these flat knitting machines. Individual flat knitting machines converts the imaginal knitting data received from the design apparatus 2 to the knitting data suitable for the present knitting machine and executes to knit the tubular fabric.

Figure 2:
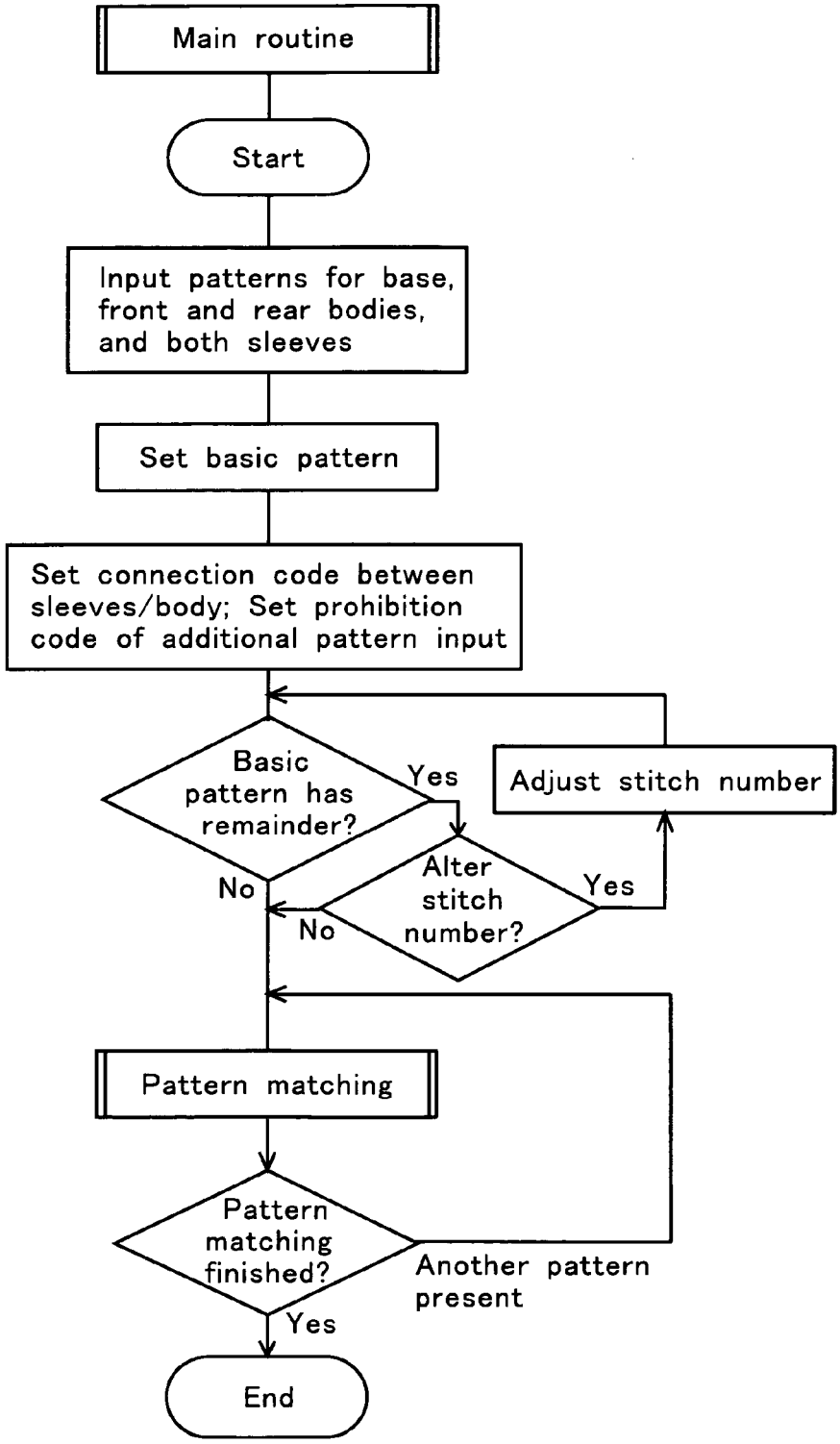
FIG. 2 is a flow chart showing the setting of basic patterns and pattern matching according to the embodiment.

FIG. 2 shows a main routine for designing the tubular fabric. Hereafter, a base means exterior pattern data of the tubular fabric. The basic pattern is the pattern repeated in the direction rounding around the tubular fabric and is a synonym of the unit pattern. The work means design data now being generated and the current view means design data for which each step of designing has been apparently completed.

By using the scanner, stylus, or keyboard, the shape of the base is inputted. By this way, patterns of the base, front body, rear body, and both sleeves are inputted. Next, the basic pattern is set to be repeated and rounding around the front and rear fabrics of the tubular fabric. Many of the basic patterns have been stored in, for example, the library and, thus, it is sufficient to select one of these patterns. Further, a connection code between the sleeves and body is set and a prohibition code of additional pattern input is set for the part, for which pattern input should be disabled for knitting the fabric. The part, for which the prohibition code of additional pattern input is designated, is exemplified by, for example, binding off of both shoulders and a connecting positions between the body and both sleeves.

The stitch number check processing unit checks whether the remainder is produced in the stitch number, when the basic pattern is repeated to round around the tubular fabric. This check is carried out for checking whether the total stitch number of the front and rear fabrics becomes a multiple of the stitch number necessary for the basic pattern. When the remainder is produced in the stitch number during repetition operated to round around the basic pattern, the message reporting the remainder is displayed on the monitor and the query whether the stitch number should be altered is displayed on the monitor. In accordance with this query, if the user inputs selects the alteration of the stitch number, the stitch numbers of such as the front body, rear body, and both sleeves are altered to allow the basic pattern to round around regularly and to prevent production of the discontinuous part. Automatic adjustment of the stitch number has an upper limit when the remainder is detected, the automatic adjustment is operated in a range of stitch numbers not influencing the size of the fabric, and, for example, alterable stitch number is up to several for both a front fabric and a rear fabric.

The remainder may be produced in the stitch number when the basic pattern is repeated. In the case where the user selects no alteration of the stitch number, the processing goes to a subroutine of pattern matching immediately. In the case where the remainder is produced in the stitch number and matching of the stitch number is not operated, it is, for example, assumed that the starting position of the pattern has been inputted for the front body to develop the basic pattern in the left and right directions from the starting position for the front body. For the rear body, according to a conventional embodiment, the pattern developed in the front body, for example, is subjected to mirror reverse for copying. In such the way, the pattern becomes discontinuous at the position of the edge. It is basically necessary to detect whether the remainder is produced in the stitch number, when the basic pattern is repeated, and to display the message to the monitor when the remainder is produced, however, the automatic adjustment function for the stitch number may not be installed. This is because the automatic adjustment of the stitch number accompanies the size alteration of the fabric.

Figure 3:
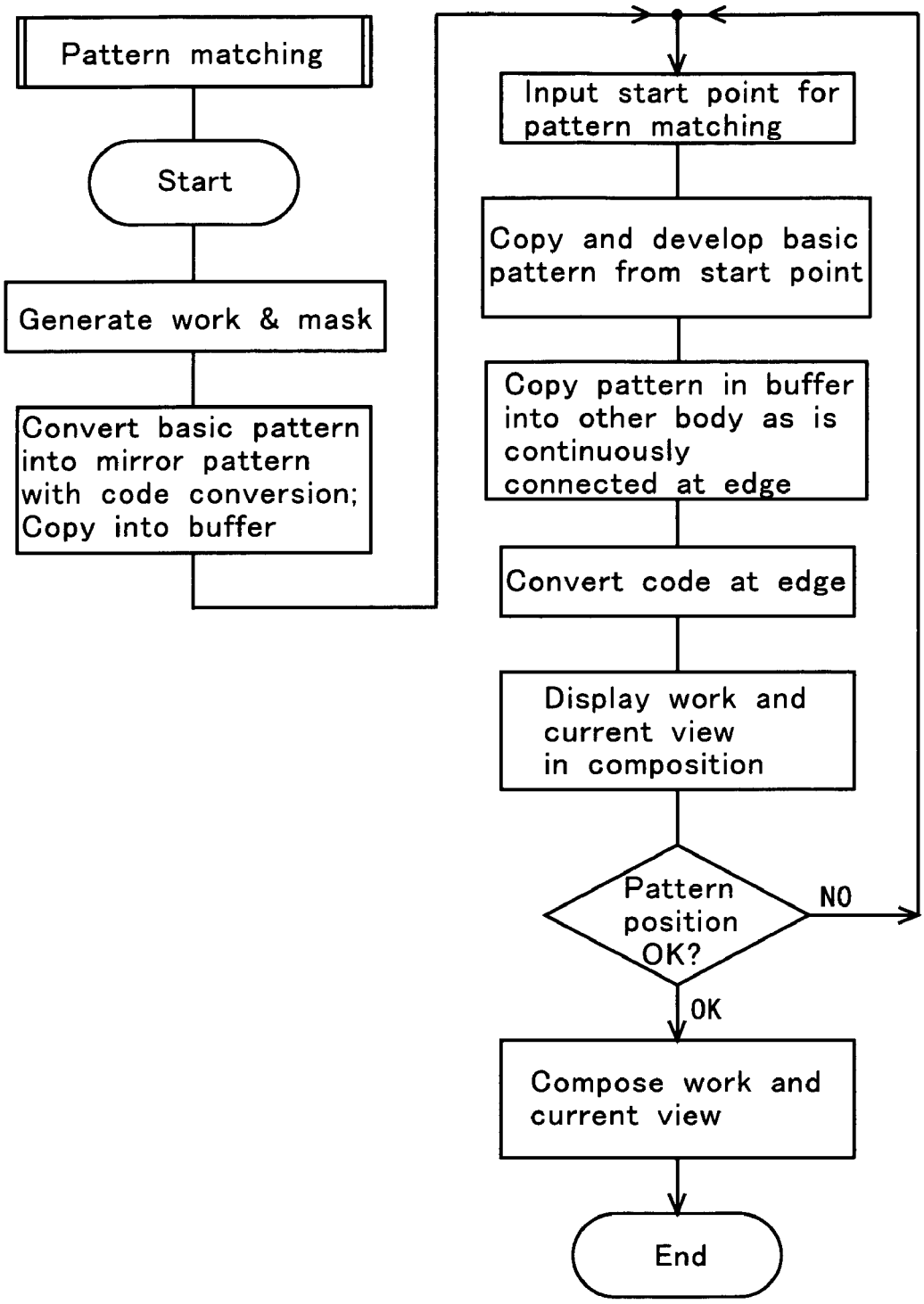
FIG. 3 is a flow chart showing a detail of the pattern matching in FIG. 2.

FIG. 3 shows the subroutine of the pattern matching. This subroutine prepares a work being a temporary file for store the pattern and generates a mask to limit a pattern input area to the part where such the fabric as the front body, rear body, and both sleeves is present. Next, when knitting operation moves from the front body to the rear body or moves from the front sleeve to the rear sleeve, the knitting data necessary for the basic pattern alters and the mirror data of the basic pattern is stored in a buffer. The mirror data to be stored in the buffer is a mirror data of the original pattern along the left and right directions. The left and right directions from a viewer's point in front of the knitting machine, etc. is reversed, the species of front and rear stitches are inverted, and the racking direction is reversed, if any. In this way, the knitting data of the basic pattern of the front body and the front sleeves, etc. can be converted to the knitting data of the basic pattern of the rear body and the rear sleeves, etc.

The monitor displays the design of the tubular fabric designed heretofore, current view, and also displays the message, that requests designation of the starting position of the basic pattern on the current view, for the user. The starting position inputted by the user may be called the start point of the pattern matching or simply the start point. The basic pattern is developed to extend to the front and rear fabrics by copying the pattern starting from the start point. The direction of development may be a single direction such as clockwise or anticlockwise and also may be both the left and right directions of clockwise and anticlockwise. And, for the opposite body, e.g., the rear body, the pattern is made continuous at the edge between the front body and the rear body and, at the same time, the mirror data stored in the buffer is copied to the opposite body. When the basic pattern is rounded around the sleeve, similarly, the basic pattern is copied starting from the front sleeve in order to cross over the edge between the front sleeve and the rear sleeve. When the edge is crossed, the mirror data stored in the buffer is copied.

For the stitch to be transferred crossing over the edge, the knitting data, code, is converted. In this code conversion, the transfer address is assigned to the opposite needle bed of the one when the edge is not crossed and, in accordance with the stitch number to be transferred beyond the edge, the needle in the transfer address is assigned to come back reversibly from the edge. Subsequently, the work prepared by repeating the basic pattern to round around the front fabric and rear fabric is displayed on the monitor in composition with the current view expressing the designed data. The user checks on the monitor whether the pattern is arranged after a user's image, e.g., whether the pattern of the fabric is leftly and rightly symmetric, whether a same part of the basic pattern appears on the left and right edges, and whether the edge is an interrupted position of the basic pattern. If the position of the pattern, or arrangement of the pattern, is not sufficient, the user designates again the start point of the pattern matching to move the pattern as the whole to the left and right directions. The start point of the pattern matching can be altered not only to left and right directions but also to up and down directions and, therefore, the arrangement of the pattern can be arranged in not only to left and right directions but also to up and down directions. When the position of the pattern is correct, the user inputs it by using the stylus on the monitor and the work is stored in composition with the current view. Returning to FIG. 2, when the pattern matching for one basic pattern is completed, if another basic pattern is set, the pattern matching is executed by using another basic pattern.

Figure 4:
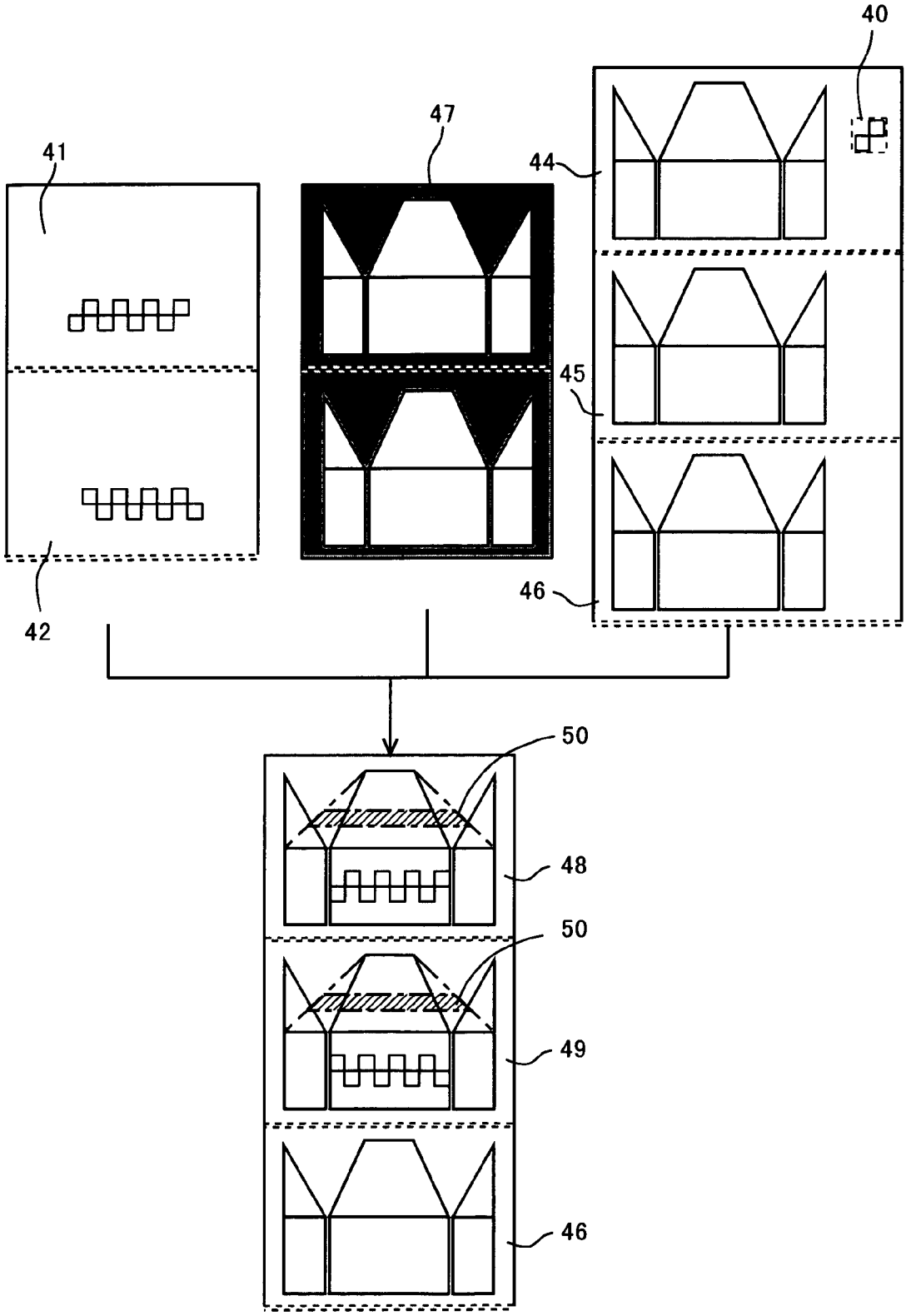
FIG. 4 is a figure showing diagrammatically a mask, current view, and work images in the pattern matching in the embodiment.

In FIG. 4, 41 is a work for the front body and the front sleeves, 42 is a work for the rear body and the rear sleeves, 44 is a current view of the front body and the front sleeves, 45 is a current view of, the rear body and the rear sleeves, and 46 is a base of these works and views. Further, 47 is a mask. The user selects a base pattern 40 to store the mirror data for this in the buffer. And, when the start point of the repeating basic pattern 40 is inputted for the front body or the rear body, the basic pattern is repeatedly copied starting at the position to make the works 41 and 42. When the edge appears in an inner position of one of the basic pattern 40, the mirror data stored in the buffer is used for the part remained beyond the edge to make the basic pattern at the edge continuous. And, within the mark 47, works 41 and 42 are combined with the current views 44 and 45, and they are displayed on the monitor as one at the bottom of FIG. 4.

If the start point of the pattern is inappropriate, the problem that the pattern does not make left and right symmetry, and so on, arises. In such a case, the user can input again the start point of the pattern to move left and rightly the pattern in parallel and also to move up and downly the pattern in parallel. The pattern can be moved in parallel not only left and rightly but also up and downly. Therefore, not only the pattern can be made continuous at the left and right edges, but also the arrangement of the pattern can be altered on the front and rear fabrics for the pattern crossing beyond the shoulder lines. When the user approves the representation at the bottom of FIG. 4, the works 41 and 42 are composed with the current views 44 and 45, and the resultant images are stored in the memory as a new current views 48, 49.

In the current views 48 and 49 of FIG. 4, pattern 50 is shown. The pattern rounds around a single tubular body composed of the front body, both the left and right sleeves, and the rear body in the upper part of a garment, i.e., the part upper than an armpit in this figure. For pattern 50, extending to an upper part than the armpit, as shown by chain lines in the current views 48 and 49, it makes design easy to show pattern 50 in such a way that the upper parts of the sleeves are connected to the front and rear bodies, since the connection in the pattern between the front and rear bodies and the sleeves. Further, the representation by the chain lines in the current views 48 and 49 is an example about the display on the monitor and does not restrict how to store the data.

Figure 5:
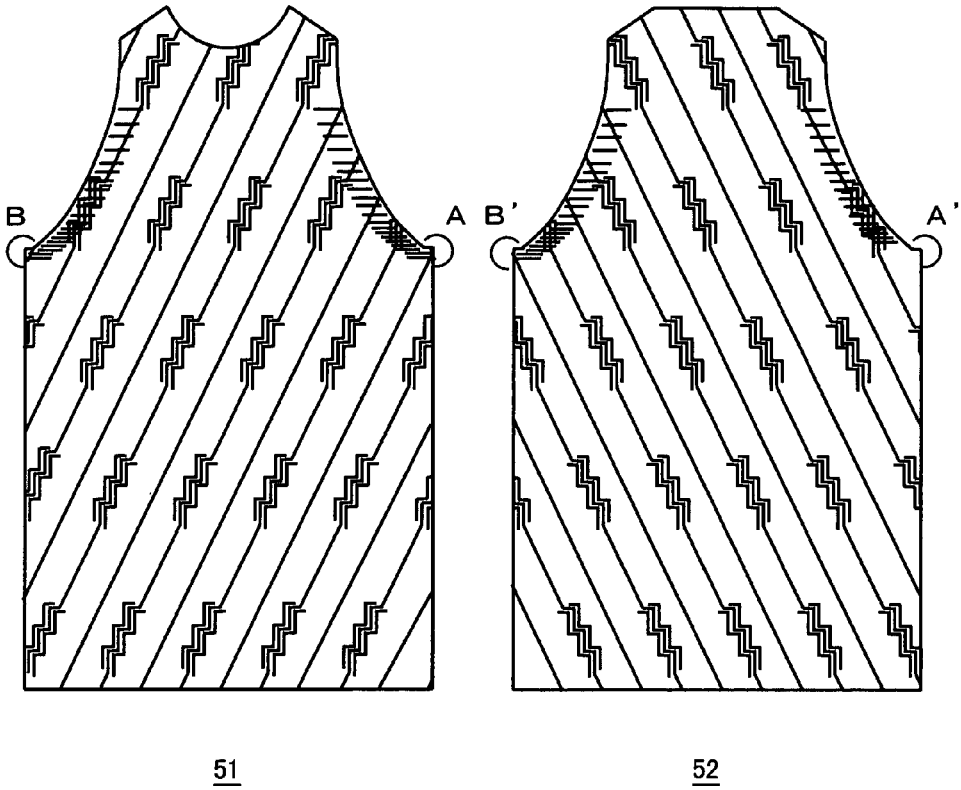
FIG. 5 is a figure showing an embodiment of a design for a rounding pattern in the embodiment.

FIG. 5 shows a vest as the embodiment of the design for the tubular fabric. 51 denotes the front body and 52 denotes the rear body. Point A is connected to point A' and point B is connected to point B' in the figure. The basic pattern in this case is composed of two lines going from the right side to the left side, when the front body is viewed in the front. It presents the design of the tubular fabric to round the basic pattern composed of two lines entirely from the front body 51 to the rear body 52 in a specific pitch. In the part upper than A, B, A', and B' points, codes for the narrowing for the arm hole are written, and an additional pattern input is prohibited in this part. There is some other parts prohibited from additional pattern input around both shoulders and the neck hole.

In FIG. 5, when the start point of the basic pattern is designated on the monitor, the basic pattern is copied to repeat extending from the position to both the front and rear bodies. The species of the face and rear stitches, development directions and the racking direction are reversed from each other between the front body and the rear body, and the code conversion as described above is executed for the stitch to be transferred beyond the edge. In addition, if the start point of the development is inappropriate, the start point can be altered. Further, if the remainder of the stitch number is produced when the basic pattern is repeated, the message concerning the remainder is displayed on the monitor. To the query whether correction of the stitch number should be operated, if correction of the stitch number is selected, the stitch number is automatically adjusted.

Figure 6:
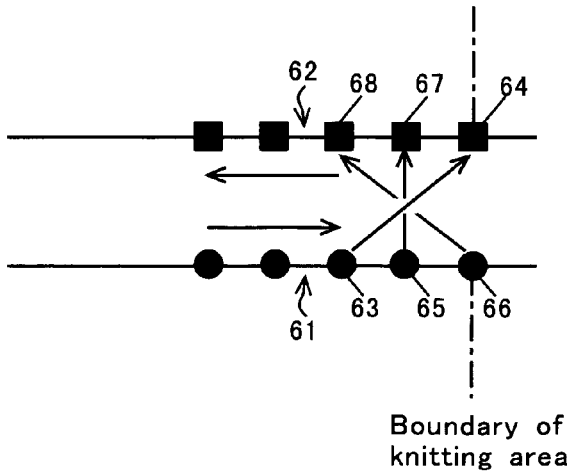
FIG. 6 is a figure showing diagrammatically an example of code conversion at an edge in the embodiment.

FIG. 6 shows a processing of stitch transfer crossing over the edge. 61 denotes a front needle bed and 62 denotes a rear needle bed. For example, it is hereby assumed that the code of transfer to right by three stitches is designated for the stitch located on needle 63 of front needle bed 61. Then, the stitch is to be transferred beyond the boundary of a knitting area, i.e., the edge. Thus, the stitch is transferred to the rear needle bed, the opposite needle bed to the front needle bed to which stitches transferred within the edge are transferred. The stitch is transferred to a needle returning from the edge by the stitch number beyond the edge. For example, the stitches are transferred from needle 63 to needle 64, from needle 65 to needle 67, and from needle 66 to needle 68.

Figure 7:
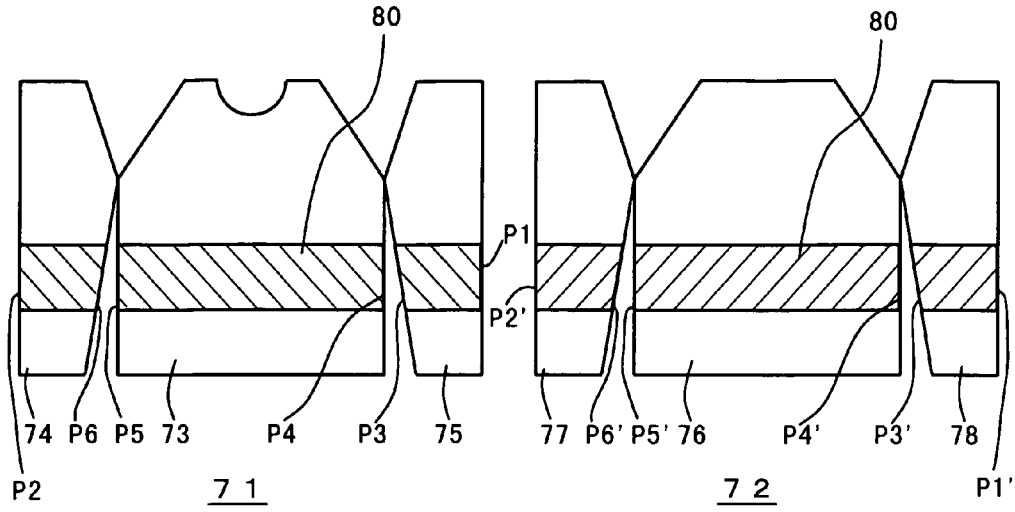
FIG. 7 is a figure showing diagrammatically pattern matching between sleeves and the body in the embodiment.

FIG. 7 shows diagrammatically proceedings of the continuity of the pattern in the edge between front and rear fabrics and the continuity of the pattern between the sleeve and the body. 71 denotes a front fabric, 72 denotes a rear fabric, 73 denotes a front body, 74 and 75 denote front sleeves, 76 denote a rear body, and 77 and 78 denote rear sleeves. It is assumed that a pattern 80 is designed to round around the front and rear bodies 73 and 76, and both the sleeves 74, 75, 77, and 78, as a whole. P1 to P6 are pattern matching points related to pattern matching; the edge between front and rear left sleeves is between P1 and P1' and the edge between front and rear right sleeves is between P2 and P2'. There is an indistinct edge between P3 and P3' that is between the left front and rear sleeves and near the body. There is another edge between P6 and P6' that is between the right front and rear sleeves. Priority of pattern continuity is:

1. Edge between front and rear bodies (points P4–P4' and P5–P5') and front and rear sleeves (points P1–P1' and P2–P2') are in high priority; and
2. Edge between body and sleeve (points P3–P4, P5–P6, P3'–P4', and P5'–P6') are in the next priority.

In FIG. 7, the pattern has not been developed in the connection part between the bodies and the sleeves. Therefore, the priority to pattern continuity between bodies and sleeves is less than the priority to pattern continuity between front and rear bodies and front and rear sleeves.

Figure 8:
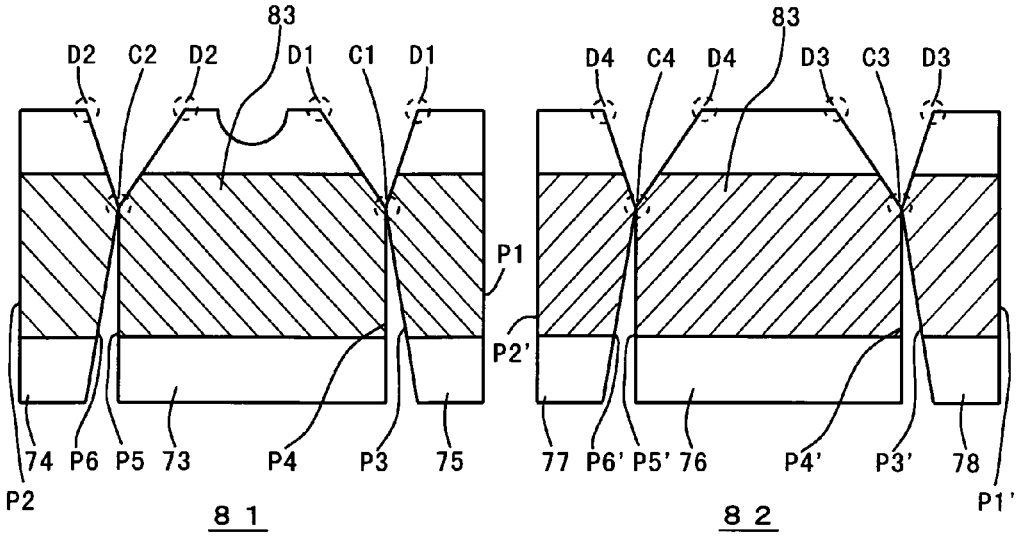
FIG. 8 is a figure showing diagrammatically another embodiment of pattern matching between the sleeves and the body in the embodiment.

As shown in FIG. 8, when the pattern is developed in the connection part between the sleeve and the body, the pattern continuity between the body and the sleeve, in particular, that at the connection part between them, is generally important to get beautiful garments than that between the front and rear sleeves. In FIG. 8, 81 denotes a front fabric, 82 denotes a rear fabric, 83 denotes a pattern, and C1 to C4 and D1 to D4 denote top and bottom ends of the connected positions between the bodies and the sleeves. Since C1, C2, C3, and C4 are connected positions between the bodies and the sleeves, the priority is given to continuity at them. The same reference numerals as those of FIG. 7 express the same entities. When the pattern is developed spreading across these areas, the priority of pattern continuity is, for example, as follows:

1. Edge between front and rear bodies (points P4–P4' and P5–P5');
2. Connected position between the bodies and the sleeves (connected positions C1, C2, C3, and C4); and
3. Between front and rear sleeves (points P1–P1' and P2–P2').

In the pattern matching in FIG. 7, the pattern is first rounded to make the pattern continuous between front and rear bodies, and if necessary, the stitch number of the bodies is adjusted. The pattern is developed to make the pattern continuous between front and rear sleeves, and if necessary, the stitch number of the sleeve is adjusted. Subsequently, to make the pattern continuous between the bodies and the sleeves, the start points of the pattern of the bodies and the sleeves are adjusted.

In the pattern matching in FIG. 8, the pattern is first rounded to make the pattern continuous between front and rear bodies, and if necessary, the stitch number of the bodies is adjusted. Subsequently, to make the pattern continuous at the connected positions in armpits between the bodies and the sleeves, the pattern 83 is developed in the sleeve starting at the connected positions C1, C2, C3, and C4. When the pattern 83 is made continuous at the connected position C1, and when the pattern 83 is made continuous at the connected position C3 in the rear side, the pattern cannot be made continuous in the connected position between the body and the sleeve and, thus, the stitch number of the sleeve is adjusted. If the stitch number is not adjusted, continuity of the pattern in the connected position between the body and the sleeve is made by making the pattern not continuous between front and rear sleeves.

Figure 9:
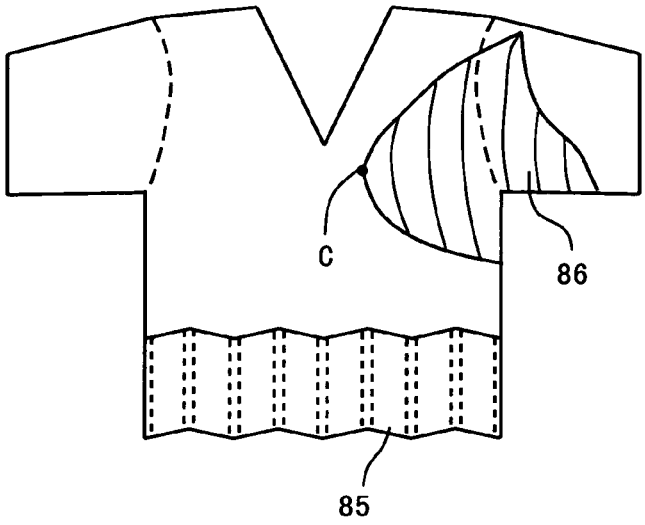
FIG. 9 is a figure showing diagrammatically an example of applying the embodiment, in addition to the rounding pattern, to a pattern extending to both a front body and a front sleeve.

FIG. 9 shows an embodiment of making a rounding pattern 85 made by copying the basic pattern to round the front body and the rear body, and a big pattern 86 extending to both the front and rear bodies and also front and rear sleeves. For the design for the rounding pattern 85, as described above, the basic pattern and the start point thereof are designated. In the buffer, mirror data, which subjects the basic pattern to mirror conversion, makes conversion between front stitches and rear stitches, and converts the racking directions, is stored. When the total stitch numbers of the front and rear fabrics are not multiple of the number in the basic pattern, and therefore, when there is a remainder, this fact is displayed, and the stitch numbers are automatically adjusted, if necessary. When a pattern comprising the repetition of the basic pattern in one cycle is prepared, it is displayed in composition with the current view and, when the user acknowledges this design, the design for the basic pattern is completed.

The pattern 86 is, for example, made in a big flower pattern. In this case, the flower pattern is developed from the point designated as the start point, for example, point C in the front body, to the front body and the rear body and the front sleeve and the rear sleeve, and the pattern is continuously developed in the connected position between the front body and the front sleeve. When the boundary between the front body and the rear body and the boundary between the front sleeve and the rear sleeve are crossed, the pattern is developed, with the developing direction being reversed, and with the stitch species and the racking directions being invested. For development of the pattern 86, check of the stitch number is unnecessary and, however, development of the pattern from the start point, a function of changing the start point, code conversion at the edge, and the processing as described above for the fabric in the opposite position, use of the mirror data, are necessary. In the embodiment, the rounding pattern produced by repeating the basic pattern is particularly important; however, designs extending to the front and rear fabrics, not circulating the fabrics, as the pattern 86 is usable.

Figure 10:
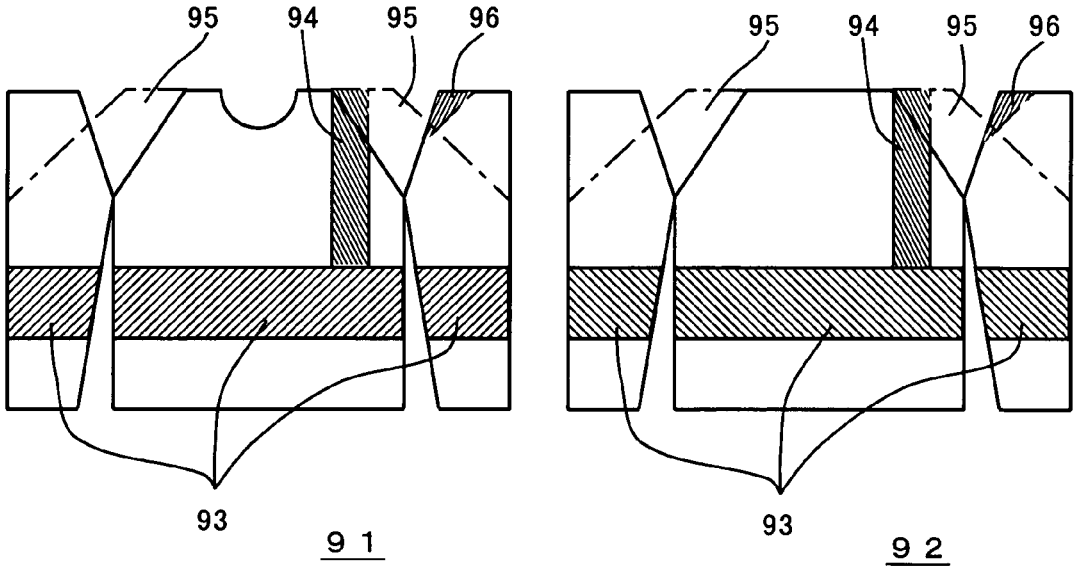
FIG. 10 is a figure showing diagrammatically a design arrangement including a vertical pattern in addition in the embodiment.

FIG. 10 shows an example of pattern arrangement where the up and down directions are took into consideration. 91 denotes a front fabric, 92 denotes a rear fabric, 93 denotes a pattern rounding around the front fabric 91 and the rear fabric 92, and 94 denotes a pattern developed in the vertical direction and crosses over the front fabric 91 and the rear fabric 92 beyond the shoulder line. The part extending to the sleeve in the pattern 94 is difficult to see in the original state and, therefore, as shown by chain lines 95, displayed by connecting the body and the sleeves. If display is carried out without the connection of the body and the sleeves, the pattern in the sleeves become difficult to see, since it is shown as a part 96.

The pattern 93 can be moved to the left and right directions as described above to make the image finer. For the pattern 94 made by, for example, arranging repeatedly the basic pattern up and down, the pattern 94 is moved up and down to make the balance of the pattern arrangement in the front and rear fabrics better. And, for the pattern 94, when the boundary between the front and rear fabrics at the shoulder line or the like is crossed, the species of the stitch are inverted from each other, the racking directions is left and rightly inverted from each other. When the pattern 94 is developed from, for example, the front fabric 91 side, the pattern is developed to be arranged from the top to the bottom of the fabric in the opposite rear fabric 92 side. Further, the end position of the pattern 94 in the rear fabric 92 is, for example, located at the equal height to that of the start point of the pattern on the front fabric 91.

The invention claimed is:

1. A design apparatus for a tubular fabric, the apparatus designing the tubular fabric composed of front and rear fabrics and producing knitting data allowing a flat knitting machine having at least a pair of front and rear needle beds to knit the tubular fabric, being characterized by:

a monitor to display an external shape of the front and rear fabrics and a pattern on the fabrics;

pattern input means for receiving input of a pattern extending to both the front and rear fabrics and for receiving input of a start point in the fabrics according to the designation of the point on the monitor by a user; and pattern development means for developing the pattern along with a direction around the front and rear fabrics from the start point in such a way that the developed pattern extends to both the front and rear fabrics and is substantially continuous at an edge between the front and rear fabrics, wherein species of stitches in the fabrics are designated so as to express the pattern in front and rear fabrics by the pattern development, and wherein species of face and rear stitches and racking direction along a left and right direction are inverted when the pattern crosses said edge.

2. The design apparatus for the tubular fabric of claim 1, wherein the pattern development means is adapted for repeating an unit pattern in such a way that the repeated unit patterns round the front and rear fabrics when the pattern inputted from the pattern input means includes repetition of the unit pattern, and wherein the pattern developed so as to round the front and rear fabrics is displayed on the monitor in composition with the external shape of the fabric.

3. The design apparatus for the tubular fabric of claim 1, wherein the pattern development means determines a needle thereto to transfer a stitch to be transferred across said edge, in the opposite needle bed to the one when transfer is made within the edge, as reversing from the edge according to a stitch number across the edge.

4. The design apparatus for the tubular fabric of claim 2, being characterized by detection means for detecting discontinuity in the pattern due to discrepancy of stitch number when the unit pattern is developed so as to round the front and rear fabrics.

5. The design apparatus for the tubular fabric of claim 4, being characterized by stitch number adjustment means for displaying the discontinuity in the pattern on the monitor, for displaying on query whether adjustment in the stitch number is done, and for adjusting the stitch number of the front and rear fabrics, in response to input requesting the adjustment in the stitch number, so as to make the pattern substantially continuous.

6. A design method for a tubular fabric having front and rear fabrics, the method producing knitting data allowing a flat knitting machine having at least a pair of front and rear needle beds to knit the tubular fabric, being characterized by:

displaying an external shape of the front and rear fabrics on a monitor;

receiving input of a pattern extending to both the front and rear fabrics and for receiving input of a start point of the pattern by user's designation of the point in the fabrics on the monitor; and developing the pattern along with a direction around the front and rear fabrics from the start point in such a way that the developed pattern extends to both the front and rear fabrics and is substantially continuous at an edge between the front and rear fabrics, wherein species of stitches in the fabrics are designated so as to express the pattern in front and rear fabrics by said development, wherein species of face and rear stitches and racking direction along a left and right direction are inverted when the pattern crosses said edge, and wherein the developed pattern is displayed on the monitor in composition with the external shape of the front and rear fabrics.

* * * * *